US005774923A

United States Patent [19]

Halm

[11] Patent Number: 5,774,923

[45] Date of Patent: Jul. 7, 1998

[54] TOOTHBRUSH HAVING A FLEXIBLY LINKED ZONE IN ITS HEAD

[75] Inventor: Hans Halm, Herne, Germany

[73] Assignee: SmithKline Beecham plc, England

[21] Appl. No.: 480,075

[22] Filed: Jun. 7, 1995

Related U.S. Application Data

[63] Continuation of Ser. No. 122,407, Sep. 27, 1993, abandoned.

[51] Int. Cl.[6] ..... A46B 9/04

[52] U.S. Cl. ..... 15/167.1; 15/172; 15/201

[58] Field of Search ..... 15/144.1, 167.1, 15/167.2, 172, 201

[56] References Cited

U.S. PATENT DOCUMENTS

| | | | |
|---|---|---|---|
| 759,490 | 5/1904 | Yates . | |
| 882,021 | 3/1908 | Schigelinsky | 15/172 |
| 4,488,328 | 12/1984 | Hyman | 15/167.1 |
| 4,520,526 | 6/1985 | Peters | 15/167.1 |
| 4,829,621 | 5/1989 | Phenegar | 15/167.1 |
| 4,864,676 | 9/1989 | Schaiper | 15/201 |
| 5,054,154 | 10/1991 | Schiffer | 15/172 |

FOREIGN PATENT DOCUMENTS

| | | | |
|---|---|---|---|
| 1 233 821 | 2/1967 | Germany . | |
| 1158936 | 7/1969 | United Kingdom | 15/201 |

*Primary Examiner*—Randall Chin

*Attorney, Agent, or Firm*—Nora Stein-Fernandez; Janice Williams; Edward T. Lentz

[57] ABSTRACT

A toothbrush having a flexibly linked zone in its head.

4 Claims, 7 Drawing Sheets

TOOTHBRUSH HAVING A FLEXIBLY LINKED ZONE IN ITS HEAD

This is a continuation of application Ser. No. 08/122,407, filed Sep. 27, 1993, now abandoned.

FIELD OF THE INVENTION

The present invention relates to a novel article, being a toothbrush, and in particular to a toothbrush having a flexibly linked zone in its head.

BACKGROUND OF THE INVENTION

When brushing one's teeth, particularly with a conventional toothbrush having a rigid head, it can be difficult to reach all parts of the teeth in order to brush the teeth satisfactorily. It is also difficult with such brushes to maintain an optimum angle between the teeth and the head of the toothbrush for effective brushing and cleaning, necessitating continual repositioning of the brush in the hand throughout the brushing process. Consequently, there is a tendency to apply excess brushing pressure to some teeth and insufficient pressure to other teeth. The resultant combination of excess brushing pressure and inadequate cleaning or bad cleaning technique can result in damage to both teeth and gums.

Although angled-head toothbrushes have been suggested as an attempt to overcome some of these difficulties, they do not satisfactorily meet all the requirements.

Proposals have also been made for toothbrushes having flexible handles or flexible zones in their handles to assist in accommodating the orientation of the bristle-bearing head of the brush to the profile of a user's teeth and gums. Such toothbrushes are disclosed for example in EP-A-0336641, U.S. Pat. No. 4520526, DE-OL-3640898, DE-OL-3612108, CH-0155730 and IT-485723.

In some circumstances it is desirable to further improve the flexibility of the head relative to the direction of the handle of the toothbrush.

SUMMARY OF THE INVENTION

Accordingly the present invention provides a toothbrush, having a handle and at one end thereof a bristle-bearing portion which comprises a bristle-bearing head which is flexibly and resiliently linked to an extended portion of the handle, the extended portion either surrounding wholly or partly the head, or the head at least partly surrounding the extended portion, the head being capable of rocking motion relative to the extended portion.

DETAILED DESCRIPTION OF THE INVENTION

The toothbrush head of this invention can move, particularly in a rocking movement, relative to the handle and can thereby accommodate itself better to the shape of the teeth than might be the case with a completely rigid toothbrush. Moreover the ability of the head to "float" relative to the handle enables a much more gentle brushing action, reducing the likelihood of injury to the gums of the user.

In a first embodiment the extended portion is in the form of a frame wholly or partly surrounding the head, the head being flexibly and resiliently linked to the frame, and being capable of rocking motion relative to the frame.

The frame in this embodiment preferably completely surrounds the head and is preferably integral with the handle.

The head in this first embodiment is preferably in the form of an undivided elongate rectangular or lozenge-shaped portion within the frame. The bristles on the head may be distributed over the head in a pattern which is conventional in toothbrush manufacture. The bristles may be distributed uniformly over the head but are preferably in discrete tufts each containing a number of bristles.

The frame in this first embodiment may also be bristle-bearing. Bristles on the frame are also preferably distributed in discrete tufts, and may have the same or different colour, distribution, length, orientation or stiffness to those on the head. Conveniently bristles on the frame are shorter than those on the head so that the bristles on the frame do not interfere with the movement of the head.

In a second embodiment the head partly surrounds the extended portion, the head being flexibly and resiliently linked to the extended portion, and being capable of rocking motion relative to the extended portion.

The head in this second embodiment may comprise a head provided with an aperture or socket within which the extended portion of the handle may fit. Such a head may be a frame of a generally, "U", "V" or "C" shape, allowing the extended portion of the handle to fit into a socket formed by, or located between the arms of the U, V or C. The bristles on the head may be distributed over the head in a pattern which is conventional in toothbrush manufacture. The bristles may be distributed uniformly over the frame-shaped head but are preferably in discrete tufts each containing a number of bristles.

The extended portion of the handle in this second embodiment may also be bristle bearing. Bristles on the extended portion of the handle are also preferably distributed in discrete tufts, and may have the same or different colour, distribution, length, orientation or stiffness to those on the head. Conveniently bristles on this extended portion are shorter than those on the head. It may be convenient for the region of the extended portion which fits within the frame shaped head to be tapered, or narrower relative to the immediately adjacent region of the handle to facilitate fitting of the extended portion within the aperture or socket.

In both of these embodiments the head and extended portion of the handle may have different colours for aesthetic appeal or to emphasise the construction of the toothbrush.

In both of these embodiments, suitably the second embodiment, it may be convenient to provide the frame-shaped head with one or more grooves in the reverse face to that from which the bristles project, to introduce some flexibility into the head. Such grooves may for example be aligned perpendicular to, parallel to or diagonally to the longitudinal axis of the handle.

In both of these embodiments the flexible and resilient linking of the head and the extended portion may be achieved in a number of ways.

In one way for example, the relative dimensions of the head and surrounding frame, or of the extended portion and the aperature or socket, may be such as to leave a gap between the head and the extended portion, the dimensions of the gap being such that the head and extended portion are capable of relative rocking motion about the gap, the gap being wholly or partially closed with a flexible and resilient material, suitably in the form of a thin diaphragm. The flexibility and resilience of such a diaphragm will depend upon the materials of which it is made, its thickness and the extent to which it closes the gap between the head and the extended portion. Suitably the flexible and resilient material may be an elastomeric material and may be coloured differently to the head and/or extended portion and/or the handle for aesthetic reasons or to emphasize the construction of the toothbrush.

In another way for example, there may be a gap as above between the head and the extended portion, and the head may be linked to the extended portion by one or more thin, flexible and resilient spines bridging the gap between the head and the extended portion.

In one such embodiment there are preferably at least two such spines positioned diametrically opposite to each other relative to the head and extended portion.

In another embodiment, such a spine may be positioned at an end of the extended portion, and extends in a direction generally in line with the longitudinal axis of the toothbrush, linking the extended portion and the head and/or the extended portion and the handle. A variant of this embodiment is that in which the extended portion is itself in the form of a thin, flexible, resilient spine extending in a direction generally in line with the longitudual axis of the toothbrush between the handle and the head.

In the above-mentioned toothbrushes in which the head and/or handle of the toothbrush is linked to the extended portion by one or more spines, or if the extended portion is itself in the form of a spine, the space between the head and the extended portion and/or the spine(s) may itself be wholly or partly closed with a flexible and resilient material which may be an elastomeric material and may be coloured differently to the head and/or extended portion and/or the handle for aesthetic reasons or to emphasise the construction of the toothbrush.

The flexibility and resilience of these spines will depend upon the materials of which they are made and their dimensions, eg length and width. The overall moveability of the head relative to the extended portion will also depend upon the number of these spines, and their distribution around the space between the head and the extended portion.

The linking of the head to the extended portion in the above-described ways allows rocking of the head relative to the handle about a number of axes. Preferably the head is at least able to rock in the plane that contains the longitudinal axis of the handle.

The diaphragm or spines may be made integrally with the extended portion and/or head or as separate parts. For example if the extended portion and/or head are made of a plastics material the diaphragm or spines may be made in the same moulding operation as the frame and/or head. If the diaphragm is made of an elastomeric material it may be necessary to make and fit this separately.

The handle, head and bristles of the toothbrush of the invention may be made of materials which are conventional in the manufacture of toothbrushes, especially plastics materials. Suitable plastics materials include, for example, polyamides and polypropylenes. An example of a suitable polyamide is the material 'Ultramid B3' (Trade mark, marketed by BASF, Federal Republic of Germany), having a modulus of elasticity (DIN 53452) of 3000. An example of a suitable polypropylene is the material 'Novolene 1100 HX' (Trade mark, marketed by BASF, Federal Republic of Germany), which is a homopolymer and has a modulus of elasticity (DIN 53457) of 1400. Such a polypropylene homopolymer may optionally be used in admixture with a polypropylene block co-polymer, such as the material 'Novolene 2500 HX' (Trade mark, marketed by BASF, Federal Republic of Germany), for example in an 80:20 mixture by weight (1100 HX:2500 HX). Suitable elastomeric materials include natural or synthetic latex type elastomers, in particular polychloroprene, natural rubber and silicones.

The handle may be of a shape which is conventional in the manufacture of toothbrushes. It may however be advantageously made in the form described in EP-0336641-A, the contents of which are included by reference, more particularly as described in column 1 lines 36–49 thereof.

In use, the toothbrush of this invention may be used for cleaning the teeth by an entirely conventional toothbrushing hand action, preferably in a manner recommended by dental health authorities. The toothbrush of the invention may also be used in electrically driven toothbrushes.

BRIEF DESCRIPTION OF THE DRAWINGS

The invention will now be described by way of example only, with reference to the accompanying drawings, in which.

DETAILED DESCRIPTION OF THE DRAWINGS

Figure 1B:
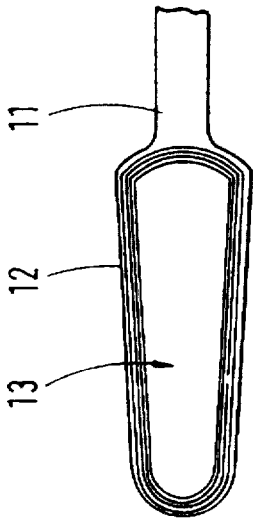
FIGS. 1A–1F shows a toothbrush of the invention having an extended portion in the form of a frame in which the linking of the head and frame is by a diaphragm.
Figure 1A:
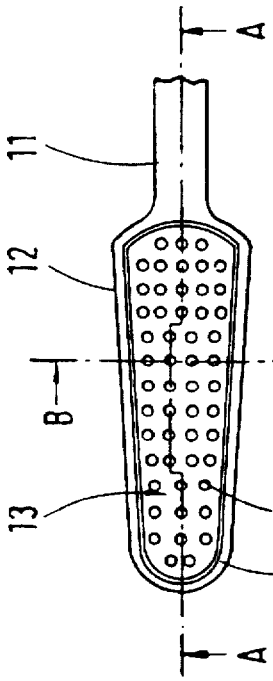
Figure 1C:
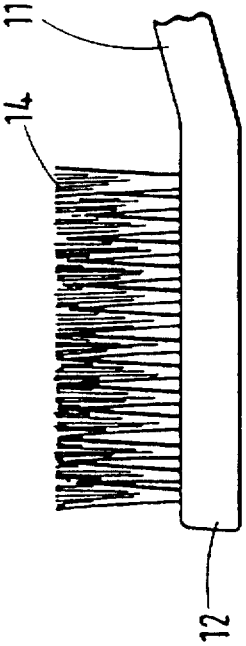
Figure 1F:
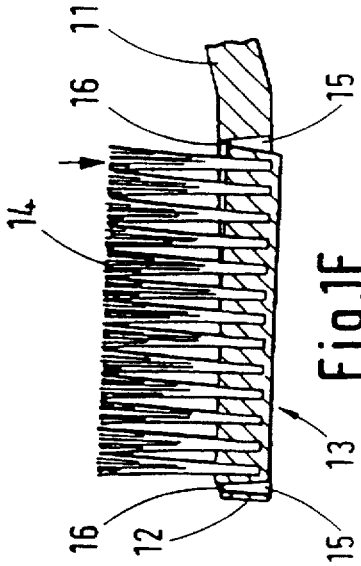
Figure 1E:
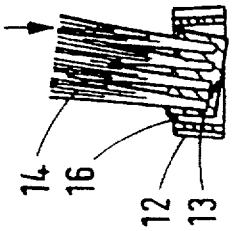
Figure 1D:
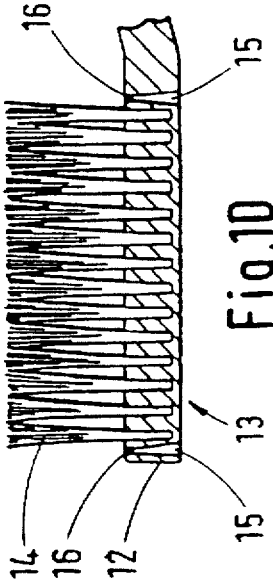

Referring to FIG. 1, the bristle-bearing portion of a toothbrush of the invention is shown in a top view in FIG. 1A, in an underside view in FIG. 1B, in an overall side view in FIG. 1C, in long section and long section view about the line A—A in FIG. 1D and 1F respectively, and in a cross sectional view about the line B—B in FIG. 1E.

In the toothbrush of FIG. 1, the handle (part shown (11)) of a toothbrush is extended to form an integral frame (12) which surrounds a rigid head (13). The upper surface of the head (13) bears bristles (14) distributed in a number of discrete tufts. The relative sizes of the frame (12) and head (13) are such that a narrow gap (15) lies between them.

The gap (15) is open on its lower side, but its upper side is closed with a thin diaphragm (16) of an elastomeric material. The thickness of the diaphragm (16) is such that it is flexible and resilient.

In FIGS. 1E and 1F the rocking movement of the head (13) relative to the frame (12) is shown, as pressure is applied to the bristles (14) at the points indicated by the arrow, the diaphragm (16) being thin enough and the gap (15) being of dimensions such as to allow this movement.

Figure 2B:
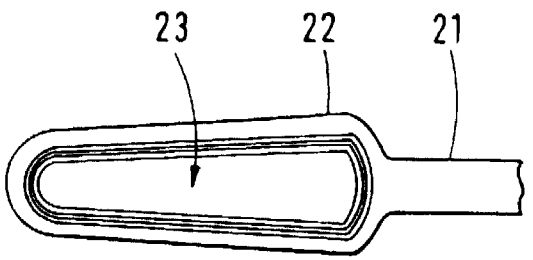
FIGS. 2A–2F shows a toothbrush of the invention having an extended portion in the form of a bristle-bearing frame.
Figure 2C:
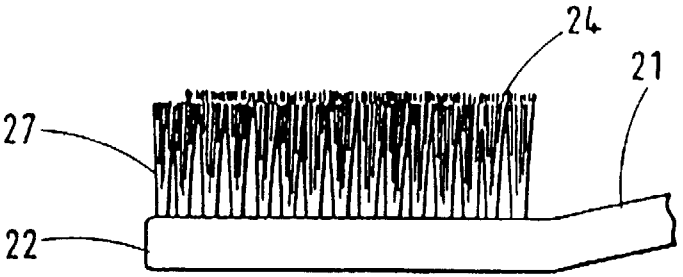
Figure 2F:
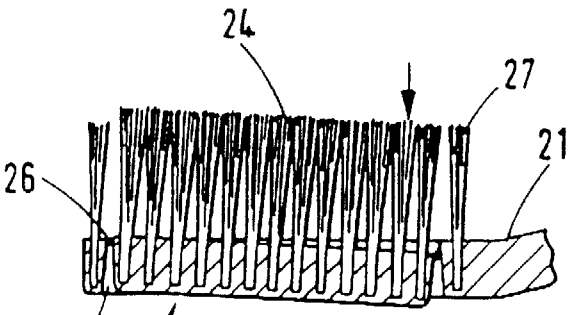
Figure 2A:
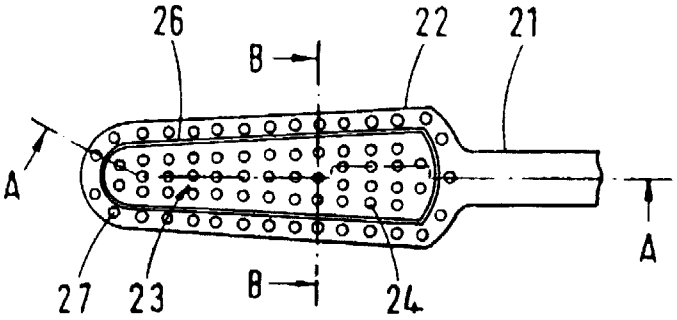
Figure 2E:
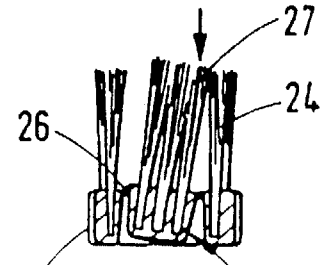
Figure 2D:
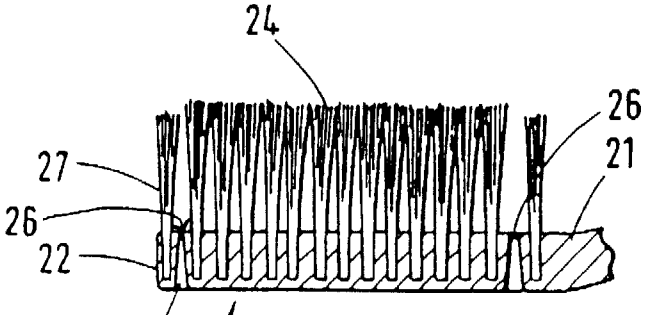

Referring to FIG. 2, the bristle-bearing portion of a toothbrush of the invention is shown in a top view in FIG. 2A, in an underside view in FIG. 2B, in an overall side view in FIG. 2C, in long section and long sectional view about the line A—A in FIGS. 2D and 2F respectively, and in cross sectional view about the line B—B in FIG. 2E.

In the toothbrush of FIG. 2, the handle (part shown (21)) is extended into an integral frame (22) surrounding a rigid head (23) which bears bristles (24), there being a narrow gap (25) between frame (22) and head (23). The lower side of the space (25) is open, and the upper side is closed with a diaphragm of an elastomeric material (26), thin enough to be flexible and resilient. The construction, disposition and rocking movement under applied pressure of these features of the toothbrush of FIG. 2 are identical to the corresponding features of FIG. 1.

In the upper surface of the frame (22) are mounted bristles (27), distributed in discrete tufts around the frame (22). These bristles (27) are shorter than the bristles (24) on the head (23).

Figure 3A:
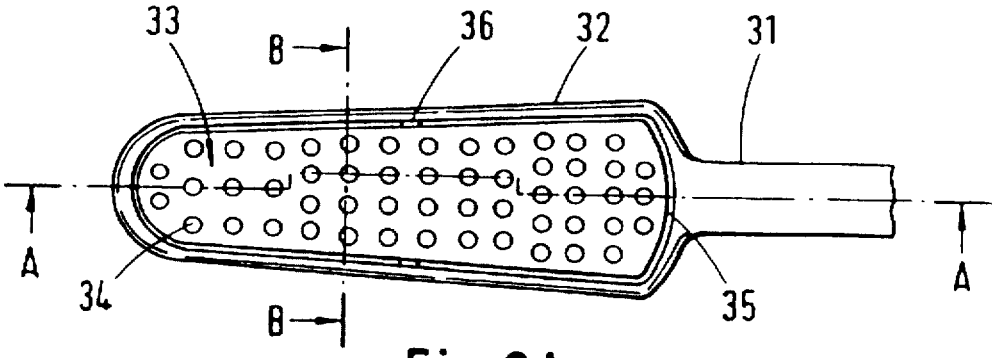
FIGS. 3A–3C shows a toothbrush of the invention having an extended portion in the form of a frame, in which the linking of the head and frame is by thin spines.
Figure 3B:
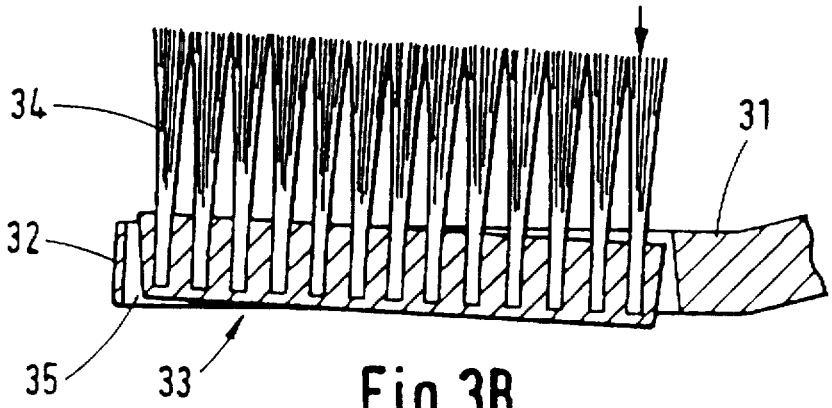
Figure 3C:
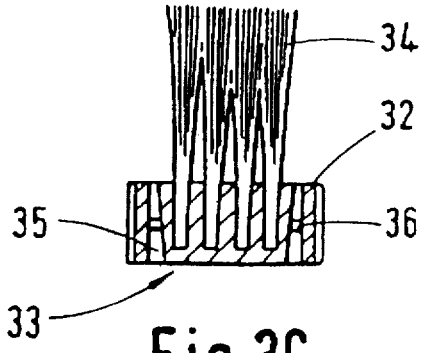

Referring to FIG. 3, the bristle-bearing portion of a toothbrush of the invention is shown in a top view in FIG. 3A, in a long sectional view about line A—A in FIG. 3B, and in a cross section about B—B in FIG. 3C.

In the toothbrush of FIG. 3, the handle (part shown (31)) is extended into an integral frame (32), surrounding a head (33), in the upper face of which are mounted bristles (34) distributed in discrete tufts, in a construction identical to the frame, head and bristle assembly of FIG. 1, leaving a narrow gap (35) between the frame (32) and head (33).

The gap (35) between the frame (32) and the head (33) is bridged by two integral thin spines (36) arranged diametrically opposite each other at approximate mid-points along the length of the head (32).

As shown in FIG. 3B, the application of pressure of the point indicated by the arrow causes rocking of the head (33) within the frame (32) about the axis of the two spines (36). By the use of spines (36) which are thin enough it is also possible for some rocking of the head (33) within the frame (32) to occur in the plane of FIG. 3C.

Figure 4B:
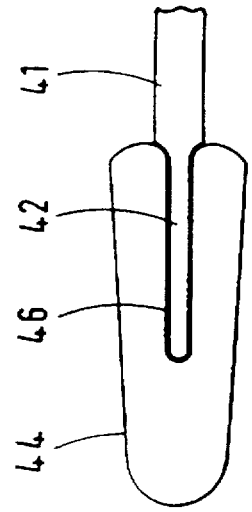
FIGS. 4A–4F shows a toothbrush of the invention having a frame-shaped head partly surrounding an extended portion.
Figure 4C:
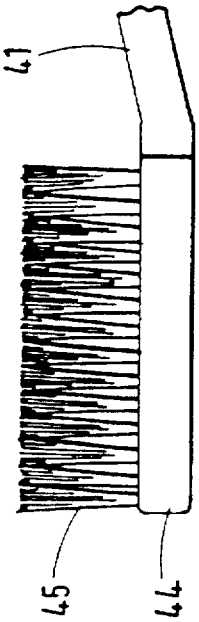
Figure 4F:
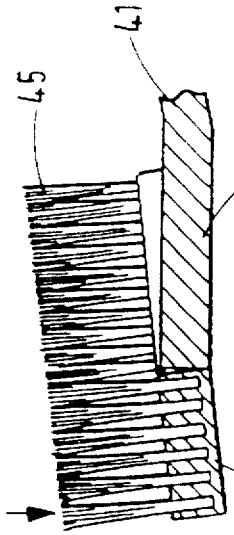
Figure 4A:
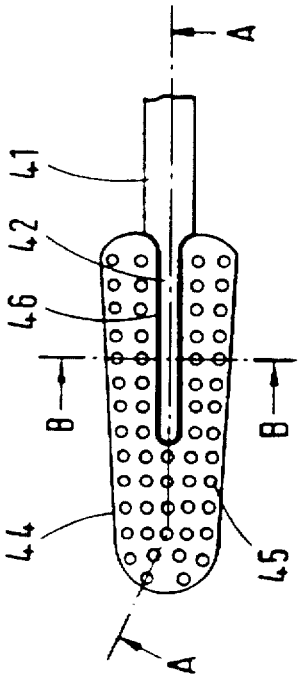
Figure 4E:
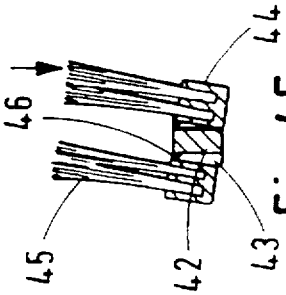
Figure 4D:
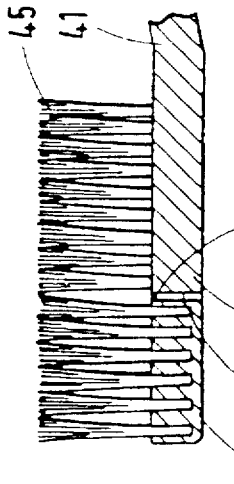

Referring to FIG. 4, the bristle-bearing portion of a toothbrush of the invention is shown in a top view in FIG. 4A, in a bottom view in FIG. 4B, in an overall side view in FIG. 4C, in long sectional view about the line A—A in FIGS. 4D and 4F, and in a cross sectional view about the line B—B in FIG. 4E.

In the toothbrush of FIG. 4, the handle (41) is formed into a narrowed extended portion (42). The extended portion (42) fits within a socket (43), in a frame-shaped head (44) of a generally "U" shape. In the upper face of the head (44) are mounted bristles (45) distributed in discrete tufts. The relative sizes of the extended portion (42) and socket (43) are such as to leave a narrow gap between the extended portion (42) and head (44).

The gap (43) is open on its lower side, but its upper side is closed with a thin diaphragm (46) of elastomeric material which is of a thickness such as to be flexible and resilient.

In FIGS. 4E and 4F the rocking movement of the head (44) relative to the handle (41) is shown, as pressure is applied to the bristles (45) at the points indicated by the arrow, the dimensions of the gap between head (44) and extended portion (42) being such as to allow this rocking.

Figure 5B:
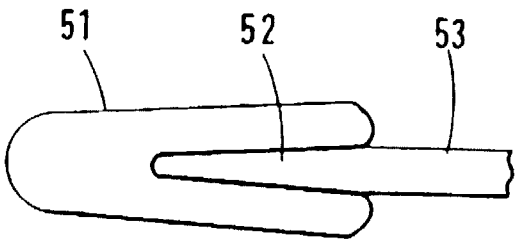
FIGS. 5A–5F shows a toothbrush of the invention having a frame-shaped head partly surrounding a bristle-bearing extended portion.
Figure 5A:
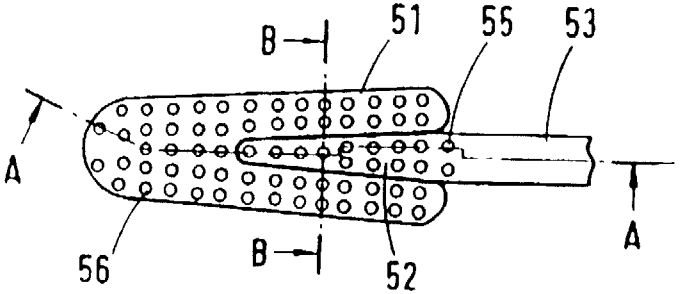
Figure 5C:
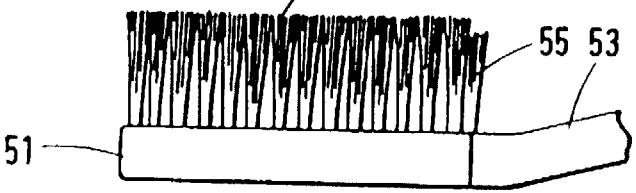
Figure 5F:
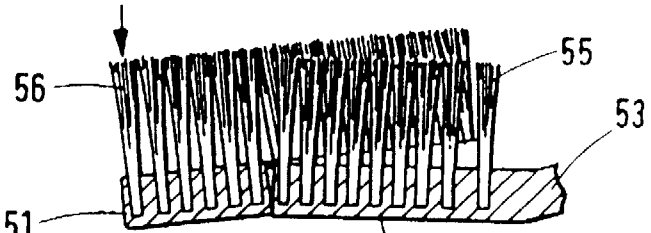
Figure 5E:
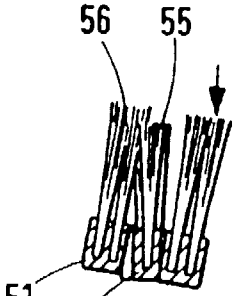
Figure 5D:
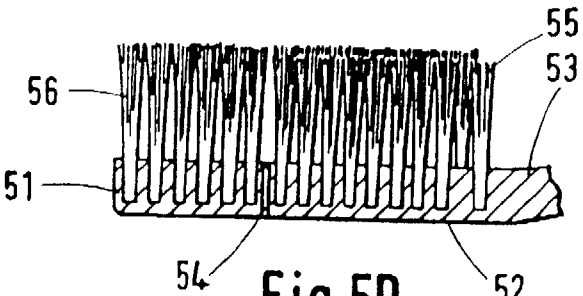

Referring to FIG. 5, the bristle-bearing portion of a toothbrush of the invention is shown in a top view in FIG. 5A, in a bottom view in FIG. 5B, in an overall side view in FIG. 5C, in long sectional views about the line A—A in FIGS. 5D and 5F, and in a cross-sectional view about the line B—B in FIG. 5E.

In the toothbrush of FIG. 5, the arrangement of head (51) and narrowed extended portion (52) of the handle (53) is similar to that of FIG. 4. The shape of the extended portion (52) is tapered relative to the handle (53) so as to fit into a socket (54) in the generally 'V' shaped head (51), the relative sizes of extended portion (52) and socket (54) are again such as to leave a narrow gap between the extended portion (52) and head (51).

The toothbrush of FIG. 5 differs from that shown in FIG. 4 in that bristles (55) are mounted on the extended portion (52) as well as on the head (51). The bristles (55) on the extended portion being shorter than those (56) on the head (51).

In FIGS. 5E and 5F the rocking motion of the head (51) relative to the handle (53) is shown, as pressure is applied to the bristles (56) at the points indicated by the arrow.

Figure 6A:
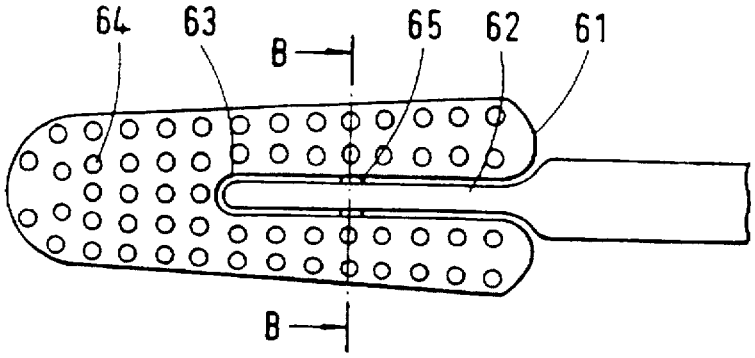
FIGS. 6A–6C shows a toothbrush of the invention having a frame-shaped head linked by spines to an extended portion.
Figure 6B:
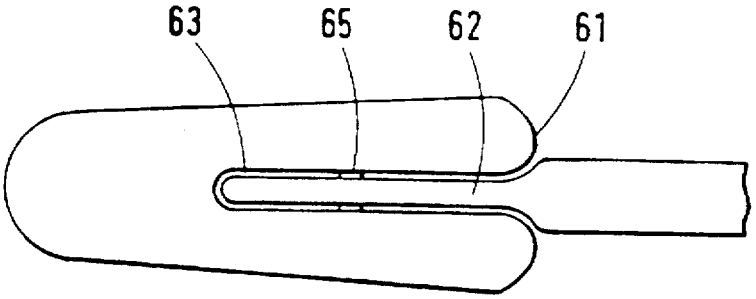
Figure 6C:
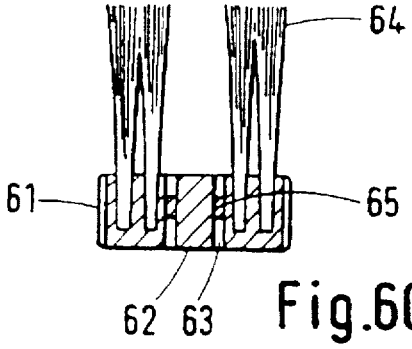

Referring to FIG. 6, the bristle-bearing portion of a toothbrush of the invention is shown in a top view in FIG. 6A, in a bottom view in FIG. 6B, and in a cross section about line B—B in FIG. 6C.

In the toothbrush of FIG. 6, the arrangement of frame-shaped head (61), extended portion (62), socket (63) and bristles (64) is identical to that of FIG. 4. The flexible and resilient linking between the head (61) and extended portion (62) is by means of two spines (65) positioned diametrically opposite each other on either side of the head (61) which bridge the gap (63) between the head (61) and extended portion (62). These spines (65) are of dimensions such that the head (61) may undergo a rocking motion relative to the extended portion (42) similar to that shown in FIG. 4F, and optionally also as shown in FIG. 4E.

Figure 7A:
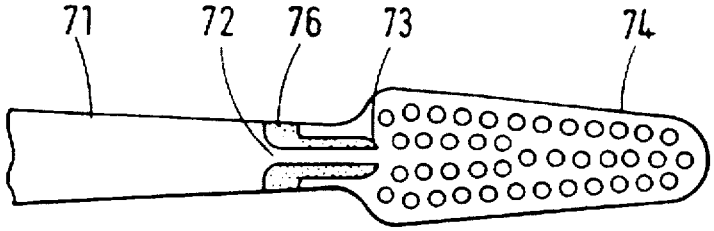
FIGS. 7A–7C shows a toothbrush of the invention having a frame-shaped head linked to the handle by an extended portion in the form of a spine.
Figure 7B:
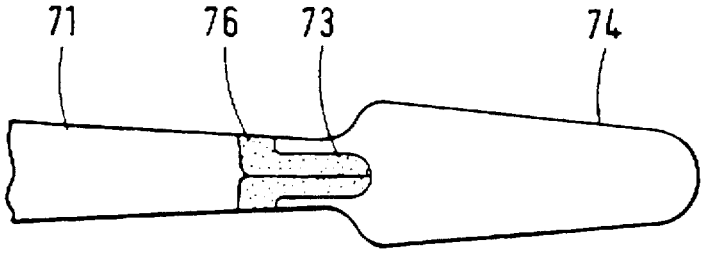
Figure 7C:
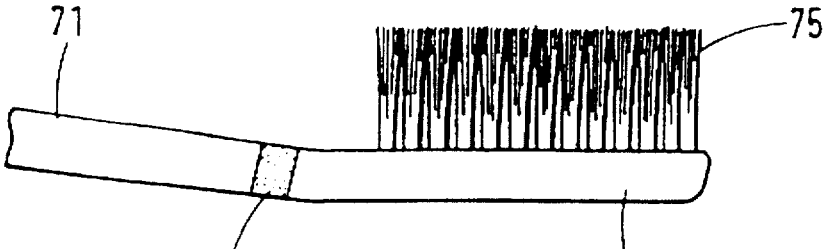

Referring to FIG. 7, the bristle-bearing portion of a toothbrush of the invention is shown in a top view in FIG. 7A, in an underside view in FIG. 7B, and in an overall side view in FIG. 7C.

In the toothbrush of FIG. 7, the handle (part shown 71), has an end which is integrally formed into an extended portion (72) in the shape of a thin flexible, resilent spine. The spine (72) extends into a socket (73) in the head (74), and is integrally joined to the head (74) at the bottom of the socket (73), thereby linking handle (71) and head (74). The spine (72) is thin enough to allow the head (74) to rock relative to the handle (71). The head (74) bears bristles (75) distributed in discrete tufts.

The space between the spine (72) and the head (74), i.e. including the socket (73) is filled with an elastomeric material (76). The material (76) modifies the rocking characteristics of head (74) relative to handle (71), and is also of a different colour to the material of the handle (71) and head (74) for aesthetic reasons and to emphasize the construction of the toothbrush.

I claim:

1. A toothbrush, having a handle and a bristle-bearing head, one end of the handle being adjacent to the head, the handle having an extended portion at the end of the handle which is adjacent to the head, said extended portion linking the head to the end of the handle which is adjacent to the head, the head being flexibly and resiliently linked to said extended portion of the handle, wherein the head is provided with an aperture within which the extended portion fits such that the head at least partly surrounds the extended portion, and wherein the relative dimensions of the head and extended portion of the handle are such as to leave a gap between the head and extended portion, the dimensions of the gap being such that the head and extended portion are capable of relative rocking motion about the gap, the gap containing a flexible and resilient material.

2. The toothbrush according to claim 1 wherein the head is in the form of a frame comprising two arms integrally linked by the material of the head and wherein said gap is formed between said arms and said extended portion, and wherein the extended portion is integrally flexibly and resiliently linked to the head at the bottom of the aperture.

3. The toothbrush according to claim 1 wherein the extended portion is in the form of a thin, flexible resilient spine, thereby linking the handle and head, the spine being thin enough to allow the head to rock relative to the handle.

4. A toothbrush having a handle and a bristle-bearing head, the handle and the bristle-bearing head being made of a plastic material, the handle and the bristle-bearing head being integrally connected to each other by the plastic material.

* * * * *